US005725151A

United States Patent [19]

Hetrick et al.

[11] Patent Number: 5,725,151

[45] Date of Patent: Mar. 10, 1998

[54] ELECTROSPRAY FUEL INJECTION

[75] Inventors: Robert Eugene Hetrick, Dearborn Heights; Michael Howard Parsons, Ann Arbor, both of Mich.

[73] Assignee: Ford Global Technologies, Inc., Dearborn, Mich.

[21] Appl. No.: 725,040

[22] Filed: Oct. 3, 1996

[51] Int. Cl.[6] ..... B05B 5/025

[52] U.S. Cl. ..... 239/3; 239/696; 239/690; 239/708

[58] Field of Search ..... 239/3, 696, 690, 239/691, 697, 698, 708, 533.12, 585.1, 585.3, 585.5; 123/538

[56] References Cited

U.S. PATENT DOCUMENTS

| | | | |
|---|---|---|---|
| 4,629,127 | 12/1986 | Kawamura et al. | 239/489 |
| 4,653,694 | 3/1987 | Noguchi et al. | 239/533.12 |
| 4,721,253 | 1/1988 | Noguchi et al. | 239/464 |
| 4,865,003 | 9/1989 | Scharnweber et al. | 239/708 X |
| 4,991,774 | 2/1991 | Kelly | 239/3 |
| 5,234,170 | 8/1993 | Schirmer et al. | 239/690 |
| 5,261,611 | 11/1993 | Huxford | 239/690 |
| 5,366,164 | 11/1994 | Jagiella et al. | 239/600 |
| 5,411,212 | 5/1995 | Munezane et al. | 239/408 |

OTHER PUBLICATIONS

Lehr & Hiller, Electrostatic Atomization of Liquid Hydrocarbons, Journal of Electrostatics, 30, 1993, 433–440.

*Primary Examiner*—Lesley D. Morris
*Attorney, Agent, or Firm*—Peter Abolins

[57] ABSTRACT

An electrospray adapted fuel injection valve includes an anode and cathode to inject monopolar electric charge into electrically insulating fuel. On exiting the injector, the charge containing fuel atomizes and disperses to reduce electrostatic energy. Additional electrodes with an appropriate method of biasing extend the range of applicability of the process by adjusting space charge distribution within the injector to compensate for variability in component manufacture and variability in the electrical conductivity of the fuel.

15 Claims, 3 Drawing Sheets

ELECTROSPRAY FUEL INJECTION

BACKGROUND OF THE INVENTION

1. Field of the Invention

This invention relates to fuel injection for internal combustion engines.

2. Prior Art

The process of injecting monopolar electric charge into an electrically insulating liquid (e.g. most hydrocarbon fuels are insulating liquids) just before that liquid leaves the nozzle of an atomizer or injector of that liquid is well known. This process results in additional atomization and spatial dispersion (radially with respect to the axis of the injector) of the charge fortified liquid since, upon entering an environment of reduced pressure on exiting the injector, the liquid attempts to reduce the electrostatic energy produced by the injected charge. Such a device is shown schematically in FIG. 1, where a fuel injector 10 in which a valve stem 11 is activated by a solenoid to move away from a valve seat 12 to allow fuel 13 to flow through and eventually out of the injector through a nozzle 14. This device can be adapted to electrospray technology by attaching a very sharp electric charge injecting electrode 15 to an extension of the valve stem while a much less sharp counter electrode 16 in the form of a small washer surrounds the charge injecting electrode. When the appropriate potential difference, V, is established by electrical power supply means 17 and connected between these two electrodes, injected electrical charge is entrained in the flowing fuel and carried out of the injector through the downstream nozzle. Under the condition of low charge injection density ($D=i_i/f$ in Coulombs/cubic centimeter, C/cc, where $i_i$ is the injected current and f is the flow rate of the fuel), very little of the injected charge is electrically conducted to and discharged at the counter electrode, since the electrical conductivity of the fuel is small. When the electric charge fortified fuel exits the injector at the nozzle, the fuel spatially disperses and atomizes into charged droplets as the liquid attempts to minimize its electrostatic energy given the initial conditions of momentum imparted to the liquid on leaving the injector. Electrode structures achieving charge injection have been taught by U.S. Pat. No. 4,380,786. U.S. Pat. No. 5,234,170 further describes electrode structures that may be used to adapt the process to common fuel injectors.

In an electrospray adapted fuel injector, the spray pattern and degree of atomization ("spray presentation") of the injector are under a degree of in-situ electrical control. In particular, the degree of atomization and dispersion increases with the amount of injected charge density in the liquid. Thus, an electrospray adapted injector is advantageous in an internal combustion engine. Consider the common case shown in FIG. 2 in which fuel is introduced by an injector 20 into an air intake passageway or port 21 that lies upstream of an intake valve 22. When the valve opens, air introduced through the throttle 23 and fuel from injector 20 are inducted into the combustion chamber 24. Engine operating conditions frequently require a particular fuel presentation in the intake port to optimize the subsequent combustion process in terms of reduced emissions. Thus, when the engine is fully warmed, it is usually beneficial to inject the fuel toward that region at the end of the port volume near the surface of the closed valve. That region is the warmest in the port volume as a result of prior combustion. Residence of the injected fuel on the interior port walls of this region for a short time is effective in evaporating the fuel prior to induction into the combustion chamber. On the other hand, under the isothermal conditions that prevail when the engine is just started, it may be more advantageous to distribute the injected fuel over the entire volume of the intake port so as to maximize fuel evaporation. The electrospray injector would enable the attainment of these different spray presentations.

A number of problems attend the practical implementation of this technology. In particular, as the amount of injected charge becomes large relative to the flow rate of the fuel (e.g. D>1 μC/cc) a number of effects related to the increasing space charge density within the fuel volume between the electrode and the nozzle can act to limit the amount of injected charge. These effects, which are related to both the magnitude of the electric potential that is built up by the injected charge and spatial inhomogeneities in the electric charge injection, act to limit the range of atomization and dispersion which are achievable. Further, the amount of injected charge at a given applied voltage, and accordingly the degree of atomization and dispersion, may vary from device to device because of small variations in the dimensions and relative placement of the electrodes. The present invention remedies both of these problems by teaching the placement and method of use of additional electrodes beyond the two (anode and cathode) required for electric charge injection.

SUMMARY OF THE INVENTION

Electric charge injected into fuel at the downstream end of a fuel injector is effective in atomizing and dispersing the fuel when it leaves the injector. This technology, referred to as "electrospray", allows for an electrically controlled, variable fuel presentation either within the port or the cylinder of an internal combustion engine. Such variability may be important in minimizing harmful emissions resulting from the combustion process, especially under transient fueling conditions such as the cold starting of the engine. In particular, variable fuel presentation is effective in maximizing the evaporation of fuel prior to combustion when considering the variable physical circumstances surrounding fuel injection during these transient conditions.

The practical implementation of electrospray technology must allow for variability in the fabrication and placement of components with very small dimensions. For example, the edge or point from which electric charge is injected into the fuel should be as sharp as possible to allow the injection to be accomplished at the lowest possible applied voltage. Variability in the sharpness may have the consequence that there will not be a single voltage value applied between the anode and cathode that will result in the desired amount of injected current. The present invention teaches an electrode downstream of the cathode which is biased in such a manner that the current injected into the fuel can be monitored. The output of an appropriate monitor can then be the input of a feedback amplifier whose output adjusts the voltage between the cathode and anode automatically until a desired value of injected current is achieved. Variability in electrode dimensions and placement can also lead to the limitations in the range over which the fuel can be atomized and dispersed due to the effects of the space charge in the fuel. These factors can be addressed by an additional electrode placed downstream of the cathode and anode, which when shaped and biased in an appropriate way, can extend the range of the amount of charge that can be injected without the space-charge limitation. In summary, two additional electrodes are taught which both enable the efficient operation and extend the range of operation of an electrospray device.

DETAILED DESCRIPTION OF THE INVENTION

Figure 1:
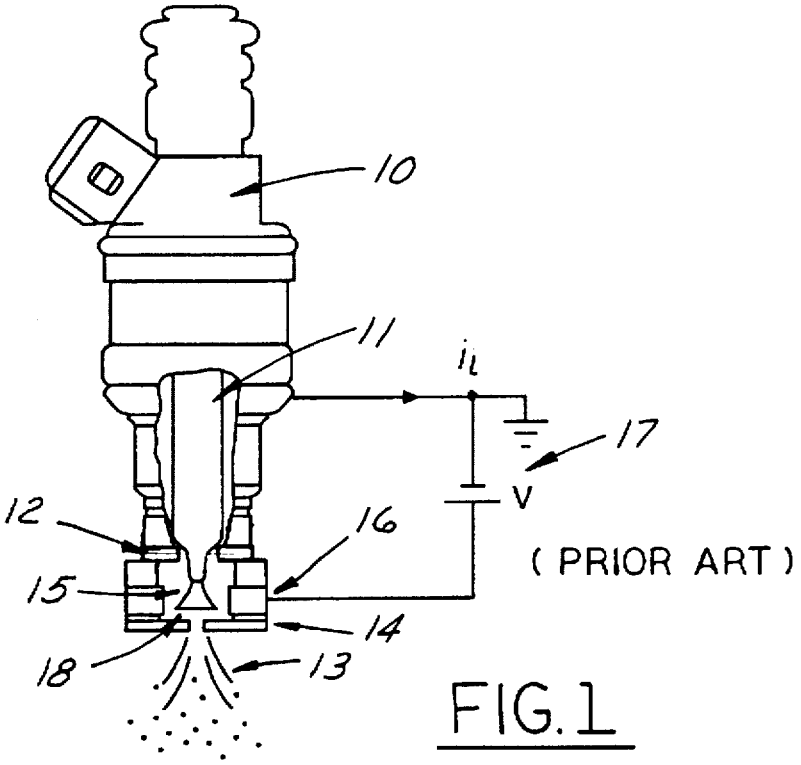
FIG. 1 shows a partial cross-section view of a prior art fuel injector adapted for injecting electric charge in the fuel to produce a higher degree of atomization and dispersion.
Figure 2:
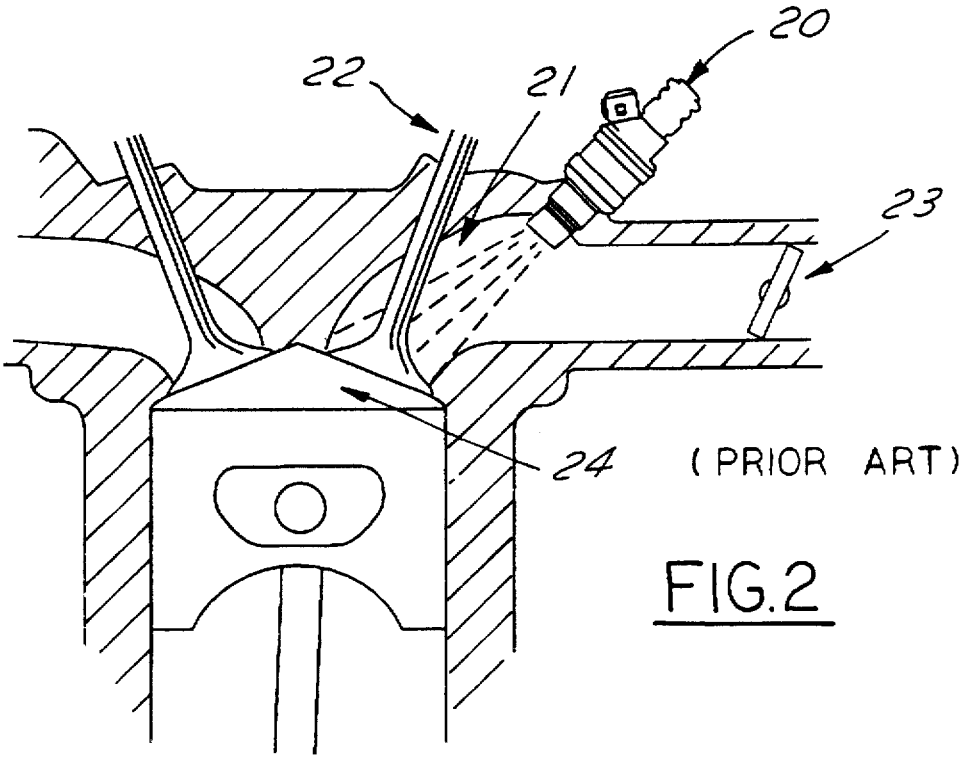
FIG. 2 illustrates the placement of a prior art fuel injector into the intake air passageway (intake port) of an internal combustion engine.

FIG. 1 illustrates one of two major classifications of two-electrode (charge injecting cathode and the anode counter electrode) electrospray configurations. In particular, this configuration is of an advantageous "radial" type in which both cathode and anode are at approximately the same axial position, but at different radial positions, along the flow path of the fluid. This can be contrasted with an alternate "axial" configuration in which both anode and cathode are at axially sequential positions along the flow path.

The "radial" configuration allows the possibility of introducing additional electrodes downstream of the anode-cathode pair to overcome practical problems in the implementation of electrospray technology. These problems are twofold. The first bears on consistently reproducing identical spray patterns with a preset anode-cathode voltage, V, considering the inevitable variability in the electrical conductivity of available fuels and the manufacturing variability in the geometries of the minute and geometrically sensitive electrodes. The second problem relates to space charge phenomena in the space between the anode and cathode as well as in the liquid volume between the anode-cathode assembly and the injector nozzle (the region designated by 18 in FIG. 1). The steady state value of space charge that exists in this fluid volume during normal operation (basically $i_i/f$) can act to limit the amount of charge that can be injected into the fuel. Thus, the degree of atomization and dispersion that can be electrically generated is limited. Again, with the advantageous radial electrode geometry of FIG. 1, additional electrodes of the present invention can be introduced into the volume to alleviate these space charge conditions.

Figure 3:
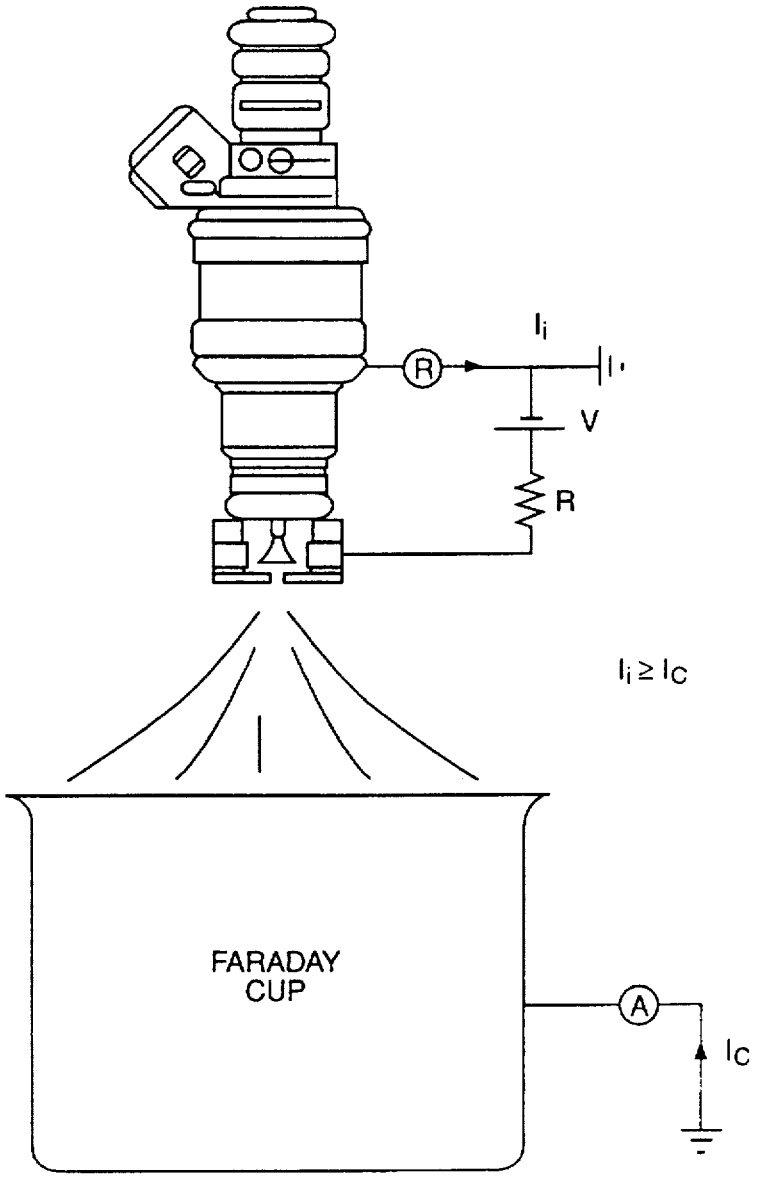
FIG. 3 is a schematic diagram of an electrospray adapted fuel injector placed in an apparatus designed to measure the various currents involved.

Both of these problems are best discussed in terms of the electrical characteristics of the electrospray injector represented in FIG. 3. Under normal operating conditions, the current injected into the fuel at the cathode, $i_i$, exceeds that which is entrained into the flowing fuel and exits the injector through the nozzle, $i_c$. This entrained current $i_c$ is measured via collection in a Faraday Cup. The excess of $i_i$ over $i_c$ is collected by the anode and flows in the anode circuit. If there is no fuel flow, then $i_c=0$, and all of the injected current flows in the anode circuit. However, as the volumetric flow rate reaches values of several cc/sec typical of automotive fuel injectors, one finds $i_i>i_c$ for an anode-cathode pair designed appropriately for the application.

Figure 4:
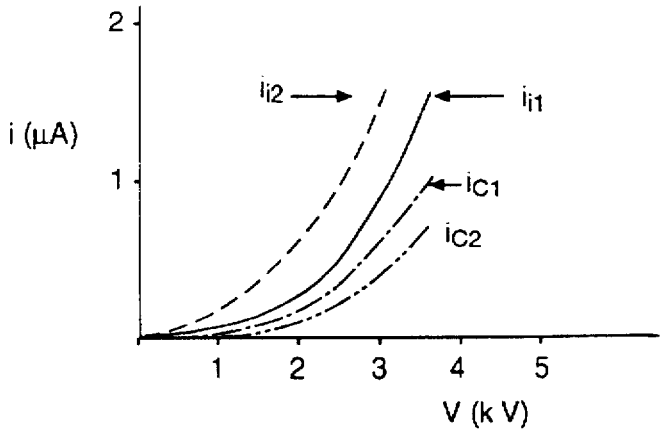
FIG. 4 graphically illustrates injected current $i_i$ as a function of voltage V applied across the electrodes.

The phenomena of charge entrainment in the fuel is predicated on the low electrical conductivity of many hydrocarbon fuels (e.g., for indolence, [fuel$<5\times10^{-11}$ S). If the conductivity increases due to the presence of more electrically conducting fuel components (such as ethanol or methanol) or other additives, then, at a given flow rate, $i_i$ will exceed $i_c$ by an amount which increases with increasing conductivity. This situation is illustrated in FIG. 4 which shows typical plots of $i_i$ and $i_c$ with V for a flow rate of a few cc/sec. Note that $i_{i1}>i_{c1}$ as expected. If the conductivity of the fuel is increased, however, $i_c$ would fall to lower values, $i_{c2}$. Similarly, if due to manufacturing variability, the cathode of a second device were sharper, or if the anode-cathode separation were smaller, then the injected current, $i_{i2}$ in FIG. 4, and the corresponding collected current, $i_{c2}$, would occur at lower values of V. In summary, expected variations in manufacturing precision or with fuel conductivity imply a corresponding variation in collected current and spray pattern at a given V.

This problem can be overcome with feedback control. One must place an electrical element in the flow of current capable of measuring $i_c$ and, subsequently, use a proportional output of this element for the feedback control of V so that $i_c$ is maintained at a preset value. Such an element is shown as part of fuel injector 50 in FIG. 5 in which an annular electrode 51, separated by an insulating spacer layer 60 from an anode 53, surrounds the flow in a region 52 downstream of anode 53 and the cathode 54. Electrode 51 is connected to ground successively through a resistor 55, a voltage source 56, and an ammeter 57 equipped with an electrical output capable of providing feedback voltage proportional to the current. Because of the large density of monopolar charge existing throughout the volume of the insulating fluid, a negative potential exists in region 52 which increases in magnitude with increasing distance along the flow path. This phenomena is similar to that occurring in a Van de Graaf generator in which monopolar charge is transported to a distant location where a potential builds up (usually at a stress distributing sphere in the case of a generator). The magnitude of the potential increases with increasing space charge density, and thus when $i_i$ is increasing, provided f is kept at a constant value. Electrode 51 will come to equilibrium with the potential existing at its downstream position. Current $i_f$ for feedback purposes can then be drawn from electrode 51 through resistor 55. This current will be proportional to the potential at electrode 51 and thus to the current $i_c$. Voltage source 56 may be inserted into the circuit to modify the current level to desirable values whereby the measured current will still be proportional to current $i_c$. The values of voltage source 56 and resistor 55 should be adjusted so that $i_f$ is much less than $i_c$. For calibration purposes, measurements can be made with the apparatus of FIG. 3 to correlate measured values of $i_f$ with corresponding values of $i_c$. With this measured correlation, the output of ammeter 57 can then be used as the negative input of a negative feedback amplifier 58 with appropriate feedback impedance and filter circuitry. The other input of amplifier 58 is a reference voltage $V_r$ which represents the desired value of $i_c$ through the previously established correlation table. The output of feedback amplifier 58 is then fed back to control the output of the anode-cathode supply voltage 59 at a value which will maintain electrode current $i_f$ at the desired value. Preferably, electrode 51 is separated from the nozzle 62 by another insulating layer 61.

Figure 6:
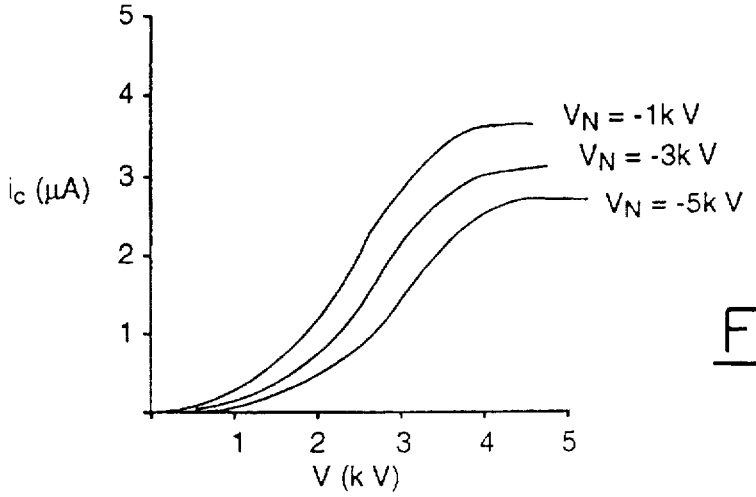
FIG. 6 graphically illustrates the phenomenon of corona breakdown that occurs when the injected charge density is not uniform.

A second problem relates to conditions which limit the amount of electric charge that can be injected into the fuel, thus limiting the degree of atomization and dispersion that can be electrically generated. This problem is illustrated in FIG. 6 which show plots of $i_c$ versus V. In FIG. 6, $i_c$ rises nonlinearly with applied voltage V to a certain value and then falls back to a lesser and near constant value with increasing applied voltage V. The point of abrupt decrease in $i_c$ is correlated with two distinct phenomena. The first is a partial collapse and coalescence of the previously dispersed and atomized spray, while the second is the appearance of a corona discharge emanating from the fuel jet just as it emerges from the nozzle. Further increases in cathode-anode voltage V only serve to increase the strength of the corona without promoting the further dispersion of the spray. The phenomena leading to the corona, with the attendant limitation of the electrospray phenomena, is spatial inhomogeneity of the injected charge which presumably occurs during the charge injection process. The inhomogeneity is maintained as the charged fuel flows through and out of the injector. As one increases the rate of charge injection, this inhomogeneity eventually leads to the premature onset of corona breakdown which originates from a region of unusually high charge density as the jet of charged fuel leaves the nozzle. In the corona process, electric charge originally in the liquid is drawn away from the liquid to participate in the gas phase collisional and ionization processes that define the corona. A consequence of the onset of corona is a loss of atomization and dispersion. After the corona onset, further increases the cathode-anode voltage V only act to intensify the corona, thus limiting any further electrospray effect.

The charge inhomogeneities that led to the corona can result from excess charge injection at some point on the circumferential edge of the cathode. This excess charge injection may be caused, for example, by an exceptionally sharp region on the edge. Another possibility is that the anode and cathode are not exactly centered on the injector axis so that their separation at some circumferential point is especially small. This phenomenon results in a greater charge injection into the liquid from that region.

Figure 7:
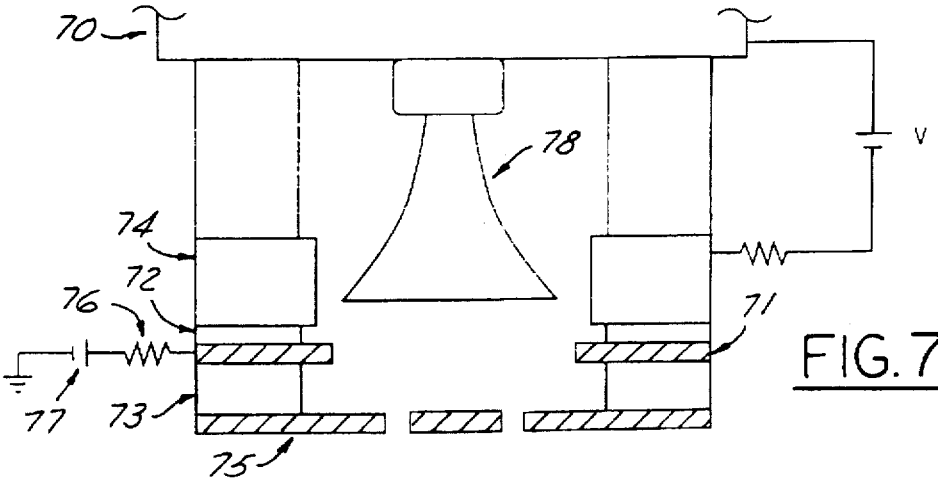
FIG. 7 is a plot of additional electrodes that can be added to diminish the current limiting effects of corona discharge and space-charge induced current saturation.

The present invention remedies the problem of charge inhomogeneitics by inserting an additional electrode 71 in the form of an annular disk into the injector 70 between the anode-cathode pair and the nozzle as shown in FIG. 7. This electrode is separated by insulating layers 72 and 73 from the anode 74 and nozzle 75 respectively. An especially advantageous dimension of electrode 71 is one in which the inner radius of the electrode disk is small enough to extend substantially into the fluid flow field. This would include the case where the radius of electrode 71 is smaller than the largest radius of cathode 78. Such geometry requires an abrupt turn of the fluid in the flow field due to electrode 71. Electrode 71, unlike anode 74 or the current sensing electrode 51 shown in FIG. 5, has a large portion of its fluid exposed surface area perpendicular to the initial flow direction. The large change in fluid momentum attending the abrupt change in flow direction will additionally serve to mechanically drive the injected charge toward electrode 71. This provides the injected charge the maximum opportunity to discharge at electrode 71 after which it will be drawn through resistor 76 by power supply 77 to ground. The magnitude of resistor 76 and of power supply 77 would be available for adjustment to limit or enhance electrode current drawn through the electrode. If the circumferential charge density within the fuel flowing past electrode 71 is not uniform, then the greater discharge to electrode 71 will come from that circumferential region where the charge density is the largest. The net result is that the circumferential charge density in the fluid emerging downstream from electrode 71 will be more nearly uniform allowing for larger values of $i_c$, and attendant greater fuel dispersion. When charge inhomogeneity is large/small, power supply 77 and resistor 76 may be adjusted to draw more/less current. Ultimately, as more and more charge is injected, corona discharge will occur providing an effective limit to the technology.

Figure 5:
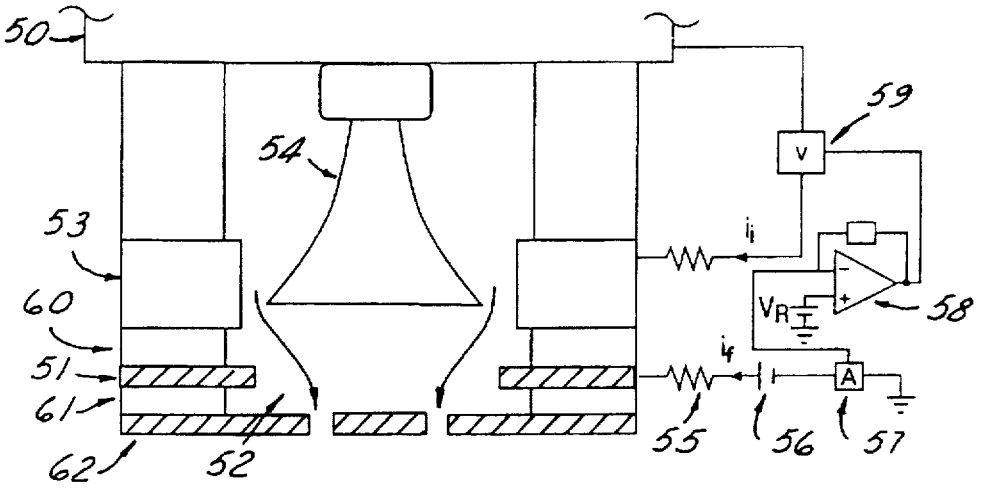
FIG. 5 is a schematic diagram of an added electrode to measure the injected current $i_i$ and circuitry for the feedback control of that current.

Although the current sensing electrode 51 in FIG. 5 and the "charge smoothing" electrode 71 appear similar, it is advantageous to use the current sensing electrode 51 downstream of electrode 71, rather than incorporate an ammeter in the circuit of electrode 71. Accordingly, charge density is circumferentially smoothed and $i_c$ can obtain the maximum range available. In that way, current sensing electrode 51 will be presented with a more homogeneous charge distribution from which to make the measurement of $i_c$.

Various modifications and variations will no doubt occur to those skilled in the art to which this invention pertains. Such variations which basically rely on the teachings through which this disclosure has advanced the art are properly considered within the scope of this invention.

What is claimed:

1. A fuel injection system for an internal combustion engine comprising:

fuel injection means having a valve stem near an end of said injection means for injecting fuel into an intake air passageway of said engine;

an anode and a cathode, located adjacent said valve stem;

a first electrical power supply and a resistor, which produce a potential difference and a resulting injection current between said anode and said cathode, thus imparting electrical charge in fuel leaving said injection means and causing the entrainment of current in a fuel flow for purposes of manipulating the dispersion of fuel in said passageway; and at least one additional electrode downstream of said anode and said cathode and electrically isolated therefrom which is used for controlling the dispersion of fuel.

2. The fuel injection system of claim 1 wherein said additional electrode is adjacent to the fuel flow and is used for monitoring the amount of said entrained current in the fuel flow passing by said additional electrode, thus providing a feedback signal for controlling the amount of charge entrained in the fuel flow.

3. The fuel injection system of claim 2 further comprising an ammeter coupled to said additional electrode for producing an electrical feedback signal comprising a feedback voltage proportional to said entrained current as measured at said additional electrode.

4. The fuel injection system of claim 3 wherein said feedback voltage from said ammeter is used to control and modify the amount of electrical charge imparted in the fuel flow by said anode and said cathode by varying said potential difference and said injection current therebetween as provided by said first electrical power supply.

5. The fuel injection system of claim 4 further comprising a resistor and a second electrical power supply inserted in series between said electrode and said ammeter, said resistor isolating said electrode from a ground, and said second electrical power supply limiting the amount of said entrained current drawn to said electrode for said feedback signal so as not to significantly diminish the density of said entrained current.

6. The fuel injection system of claim 5 further comprising a negative feedback amplifier whose input is said feedback signal from said ammeter and whose output may be used to drive said first power supply between said anode and said cathode.

7. A fuel injection system for an internal combustion engine comprising:

fuel injection means having a valve stem near the end of said injection means for injecting fuel into an intake air passageway of said engine;

an anode and a cathode, located near said valve stem;

an electrical power supply means and a resistor, which produce a potential difference and a resulting injection current between said anode and said cathode, thus imparting electrical charge in fuel leaving said injection means and causing the entrainment of current in a fuel flow for purposes of manipulating the dispersion of fuel in said passageway;

at least one additional electrode downstream of said anode and said cathode which circumferentially surrounds the fuel flow;

an ammeter, coupled to said electrode, which produces an electrical feedback signal comprising a feedback voltage proportional to said entrained current as measured at said additional electrode which is used;

a resistor and a voltage source coupled in series between said electrode and said ammeter, said resistor isolating said electrode from a ground, and said voltage source limiting the amount of said entrained current drawn to said electrode for said feedback signal so as not to significantly diminish the density of said entrained current; and a negative feedback amplifier having an input coupled to said feedback signal from said ammeter and having an output coupled to said power supply means between said anode and said cathode for varying said potential difference and said injection current therebetween as provided by said power supply means in order to control and modify the amount of electrical charge imparted in the fuel flow by said anode and said cathode.

8. The fuel injection system of claim 7 wherein said additional electrode is used to withdraw sufficient entrained electrical current from the fuel to reduce circumferentially inhomogeneous charge density in the fuel and is substantially in contact with portions of a fuel flow.

9. The fuel injection system of claim 8 wherein said additional electrode comprises an annular member, and said reduction or elimination of circumferentially inhomogeneous charge density in the fuel is performed to prevent the onset of corona discharge, which can occur when fuel containing an inhomogeneous distribution of electric charge exits said injection means at a nozzle downstream of said additional electrode.

10. The fuel injection system of claim 9 wherein said reduction or elimination of circumferentially inhomogeneous charge density is effected via the contact of the fuel flow with said additional electrode, wherein said electrode provides an opportunity for said entrained current to discharge at said electrode, wherefrom it is drawn through a resistor by a power supply means to a ground, thus removing any excess charge and homogenizing said charge density.

11. The fuel injection system of claim 10 wherein said power supply means may be adjusted to vary the amount of current drawn by said additional electrode.

12. The fuel injection system of claim 10 wherein said resistor may be adjusted to vary the amount of current drawn by said additional electrode.

13. A method of operating a fuel injector system for an internal combustion engine comprising the steps of:

manipulating the dispersion of fuel from a fuel injector means into an intake air passageway of said engine by applying electrical power to an anode and a cathode which are adjacent to a fuel flow from said injection means, thus producing a potential difference and a resulting injection current between said anode and said cathode and imparting electrical charge in fuel leaving said injection means, causing the entrainment of current in said fuel flow;

positioning an additional electrode downstream of said anode and said cathode;

monitoring the amount of said entrained current in the fuel flow passing by said additional electrode, thus providing a feedback signal for controlling the amount of charge entrained in the fuel flow; and adjusting the amount of electrical charge imparted in the fuel flow by said anode and said cathode by varying said potential difference and said injection current therebetween as provided by said power supply means based upon said feedback signal from said additional electrode.

14. A method of reducing circumferentially inhomogeneous charge density in a circular fuel flow emanating from a fuel injection means for an internal combustion engine equipped with an electrical means for manipulating the dispersion of said fuel flow as presented to an intake air passageway of said engine via the entrainment of electrical charge in said fuel flow, comprising the steps of:

positioning an additional electrode downstream of said electrical means;

allowing said entrained current to discharge at said electrode, wherein said electrode is substantially in contact with portions of a fuel flow, thus removing excess charge and tending to homogenize said charge density in order to prevent the onset of corona discharge, which can occur when fuel containing an inhomogeneous distribution of electric charge exits said injection means at a nozzle downstream of said electrode; and drawing said discharge through a resistor via a power supply means to a ground.

15. The method of claim 14 wherein said resistor and said power supply means may be adjusted to vary the amount of current discharged at said additional electrode.

* * * * *